US006568343B1

(12) United States Patent
Hill et al.

(10) Patent No.: US 6,568,343 B1
(45) Date of Patent: May 27, 2003

(54) PROTECTIVE ENCLOSURE FOR WATERCRAFT HULLS

(76) Inventors: Grant Roy Hill, 1144 West 24th Street, North Vancouver British Columbia (CA), V7P 2J2; Dennis Robert Allen, 3228 Quimby St., San Diego, CA (US) 92106

( * ) Notice: Subject to any disclaimer, the term of this patent is extended or adjusted under 35 U.S.C. 154(b) by 0 days.

(21) Appl. No.: 09/985,497

(22) Filed: Nov. 5, 2001

(51) Int. Cl.[7] ..... B63B 59/08
(52) U.S. Cl. ..... 114/222
(58) Field of Search ..... 114/221 R, 222, 114/361, 45–48

(56) References Cited

U.S. PATENT DOCUMENTS

| | | | | |
|---|---|---|---|---|
| 1,973,813 A | | 9/1934 | Kelley | |
| 3,142,283 A | | 7/1964 | Fisher | |
| 3,685,477 A | | 8/1972 | Wood | |
| 4,280,436 A | | 7/1981 | Jackson | |
| 4,280,437 A | | 7/1981 | Jackson | |
| 4,280,438 A | | 7/1981 | Jackson | |
| 4,280,439 A | | 7/1981 | Jackson | |
| 4,282,822 A | | 8/1981 | Jackson | |
| 4,693,200 A | | 9/1987 | Noble | |
| 5,152,242 A | * | 10/1992 | Bradley | 114/222 |
| 5,279,244 A | | 1/1994 | Perez-Collazo | |
| 5,549,069 A | | 8/1996 | Faidi | |
| 6,047,658 A | | 4/2000 | Tansy | |
| 6,152,061 A | | 11/2000 | Perez-Collazo | |

FOREIGN PATENT DOCUMENTS

WO WO 98/28184 7/1998

OTHER PUBLICATIONS

Armored Hull, "Protecting Your Boat and Your Wallet", brochure (1 sheet/2 sides).
Armored Hull Marine Products, "Never Clean Your Hull Again", brochure (1 sheet/2 sides).
Bottom Liner, "Never Clean Or Paint Your Boat Bottom Again!", web site pages from http://www.bottomliner.com.

* cited by examiner

*Primary Examiner*—Ed Swinehart
(74) *Attorney, Agent, or Firm*—Shlesinger, Arkwright & Garvey LLP

(57) ABSTRACT

Apparatus for protecting a hull of a watercraft floating in a body of water includes a waterproof shroud of flexible sheet material suspended from a collar which is floatable in the body of water. The collar includes a buoyant forward section and a controllably buoyant rearward section pivotally connected to the rearward section for pivotal movement between a horizontal floating position and a sunken position. The rearward section includes an interior chamber and an opening or channel that extends from the chamber to provide a water flow path between the chamber and the surrounding body of water. Controllably, the chamber may be filled either with air from an external source of pressurized air or may be allowed to flood through the channel with water from the surrounding body of water. When the chamber is flooded, the rearward section is non-buoyant and pivots to its sunken position. When the chamber is filled with sufficient air, the rearward section becomes buoyant and pivots to its floating position.

9 Claims, 8 Drawing Sheets

PROTECTIVE ENCLOSURE FOR WATERCRAFT HULLS

BACKGROUND OF THE INVENTION

The present invention relates to watercraft and, in particular, to enclosures for protecting the hull of a watercraft while moored or stationary in a body of water.

Herein, the term watercraft includes boats, houseboats, barges, scows and other watercraft that are maintained afloat by one or more hulls.

The prior art reveals a variety of enclosures designed to protect the hull of a boat while the boat is moored in a body of water. A primary purpose of such enclosures is to impair the growth of marine organisms on the hulls of boats. When a boat is enclosed, its hull will be shielded from changing marine conditions outside the enclosure. Further, water within the enclosure may be chemically treated to further impair or kill marine growth on or in the vicinity of the hull.

A relatively early example is disclosed in U.S. Pat. No. 3,142,283 (Fisher) granted on Jul. 28, 1964. Fisher discloses a one-piece sheath that is first slipped around a boat hull, then secured to the boat at deck level. However, the task of "slipping" the sheath around the hull is labor intensive and may be easier said than done. Further, the need to secure the sheath to the boat necessarily implies the presence of suitable securing fixtures on the boat.

Another relatively early example is disclosed in U.S. Pat. No. 3,685,477 (Wood) granted on Aug. 22, 1972. Wood describes an enclosure that comprises a downwardly depending framework having a gate pivotally connected to its rear portion, the framework carrying a bag formed from a flexible sheet of waterproof material. He teaches that the framework can be attached to the sides of a boat slip or alternately to a buoyant flotation means, and that the gate may be raised or lowered with the aid of gate lines which appear to be in the nature of ropes or cables. When the gate is lowered, the boat may move into or out from the confines of the framework. When the gate is raised, the boat becomes enclosed. However, the gate lines may be awkward or inconvenient to handle and need to be secured to a dock to hold the gate in its raised position. Overall, the framework is a relatively complex structure having not only the length and width necessary to form a perimeter around the boat at water level but also a significant height extending downwardly to a depth below the bottom of the hull. In its lowered position, a portion of the gate extends to an even greater depth, thus limiting the shallowness of water in which the enclosure can be used.

A more recent example, U.S. Pat. No. 6,047,658 (Tansy) granted on Apr. 11, 2000, describes a floating enclosure dimensioned to receive a boat, the enclosure including a housing having an open top, a closed bottom, a closed forward wall, closed side walls and an open rearward wall. The side walls and forward wall all have a significant vertical dimension that (as in the case of Wood's framework) exceeds the depth of the boat's hull in the water. A buoyant member or members are secured to the housing to maintain the enclosure afloat. In addition, Tansy describes a gate, itself in the nature of a wall, which is pivotally connected to the bottom of the rearward wall of the housing, and which can be pivoted downwardly to allow the boat to move into or out from the confines of the housing. The gate includes a hollow buoyant portion that extends along the top of the gate, but whatever buoyancy that portion may provide appears to be deliberately defeated by a concrete weighting rod extending within the hollow portion. The hollow portion also includes a series of holes to permit water to flood or be expelled from within the hollow portion. To raise the gate from an open position to a closed position, the hollow portion is filled through a tube with air from a compressor. To secure the gate when it is closed, Tansy provides a lock. In order to get the gate to lower, Tansy uses his compressor to suck air from the buoyant portion.

Various other protective enclosures are disclosed in the prior art. For example, see U.S. Pat. No. 4,215,644 (Jackson) granted on Aug. 5, 1980; U.S. Pat. No. 5,138,963 (Eichert) granted on Aug. 18, 1992; and U.S. Pat. No. 5,152,242 (Bradley) granted on Oct. 6, 1992.

Generally, existing designs for protective enclosures are not well adapted for ease of assembly and use. In some cases, the structures involve unnecessarily complex frameworks or housings. In the same or other cases, and apart mooring lines to a dock or the like, they require cooperating fixtures or other apparatus located on a dock (as in the case of Wood) or on a boat (as in the case of Fisher). Some designs require parts of significant size (e.g. as in the case of the walls disclosed by Tansy). The need for lines or cables to raise or lower a gate as in the case of Wood is considered undesirable. Likewise, the need for a lock to secure a gate, or for a compressor to lower a gate, as in the case of Tansy is considered undesirable. Further, it may be noted that some designs require special dock facilities or attachments in order to use the product. This is undesirable because many marinas no longer will allow any device to be secured to their dock other than by means of the dock cleats that they provide for mooring purposes.

BRIEF SUMMARY OF THE INVENTION

A primary object of the present invention is to provide new and improved protective enclosure for a watercraft hull which is relatively simple yet rugged in construction, easy to use, and which does not require any walls or framework extending to a substantial depth below water level other than to permit the watercraft to enter or leave the enclosure.

A related object of the present invention is to provide as part of the enclosure a new and improved gate which can be easily lowered or raised to allow the watercraft to have access to or egress from the enclosure.

In accordance with a broad aspect of the present invention, there is provided apparatus for protecting a hull of a watercraft floating in a body of water, the apparatus comprising a waterproof shroud of flexible sheet material and a collar which is floatable in the body of water while carrying the weight of the shroud. The collar has a periphery sized to extend around the hull at a distance from the hull. The shroud is sized to extend around the periphery of the collar and below the hull while suspended from the collar.

The collar includes a buoyant forward section having opposed sides and a forward end extending therebetween, and a controllably buoyant rearward section having opposed sides and a rearward end extending therebetween. The opposed sides of the rearward section are pivotally connected to the opposed sides of the forward section for pivotal movement of the rearward section between a horizontal floating position and a sunken position. In its sunken position, the rearward section extends downwardly and rearwardly from the forward section and the watercraft can move into or out from the confines of the collar and shroud. Thus, the rearward section can be regarded as a gate. When the rearward section is in its floating position while the watercraft is contained within the periphery of the collar, then the watercraft hull is effectively isolated from water outside the shroud. This will block marine organisms outside the shroud from moving towards the hull. Further, water within the shroud can be chemically treated to impair or kill existing marine growth on or in the vicinity of the hull.

The rearward section includes an interior chamber and an opening or channel that extends from the chamber to provide a water flow path between the chamber and the surrounding body of water. Controllably, the chamber may be filled either with air from an external source of pressurized air or may be allowed to flood through the channel with water from the surrounding body of water. When the chamber is flooded, the rearward section is non-buoyant and pivots to its sunken position. When the chamber is filled with sufficient air, the rearward section becomes buoyant and pivots to its floating position.

In a preferred embodiment, the apparatus includes a valve controlled air flow line for controllably directing a flow of air from an external source of pressurized air into the chamber to expel water from the chamber through the channel, and for controllably permitting the egress of air from the chamber thereby allowing said chamber to flood through said channel with water from said body of water. As discussed below in more detail, such features enable a user to raise or lower the rearward section of the collar with particular ease.

For ease of manufacture and assembly, the forward and rearward sections of the collar preferably are made using available pipe stock and couplings. The resulting structure is both strong and rigid. To further advantage, this enables the opposed sides of the rearward section to be pivotally connected to the opposed sides of the forward section, each by a flexible bellows joint that provides suitable hinge action.

The foregoing and other features and advantages of the present invention will now be described with reference to the drawings.

DETAILED DESCRIPTION

Figure 1:
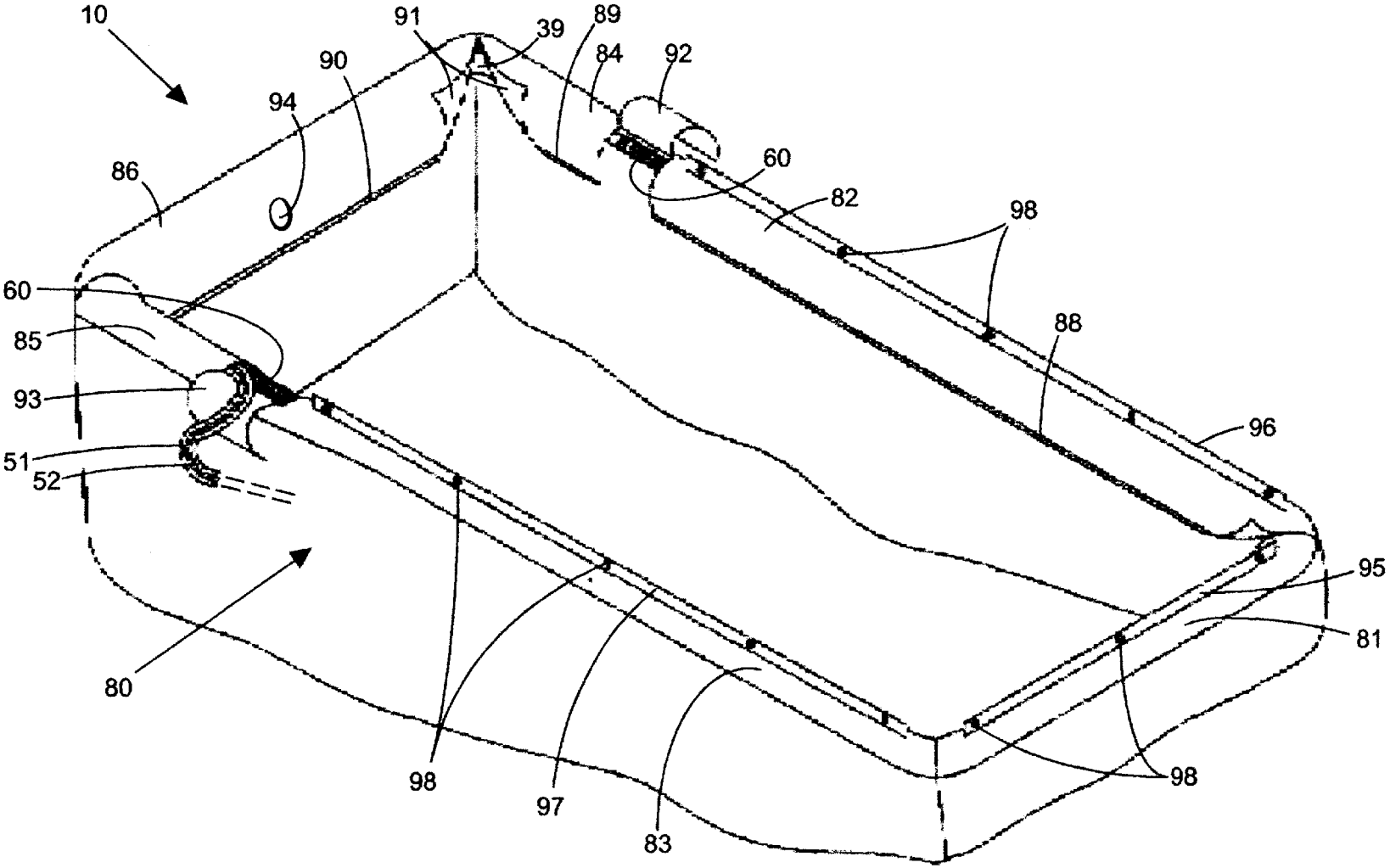
FIG. 1 is a perspective view of apparatus for protecting a boat hull in accordance with the present invention.
Figure 2:
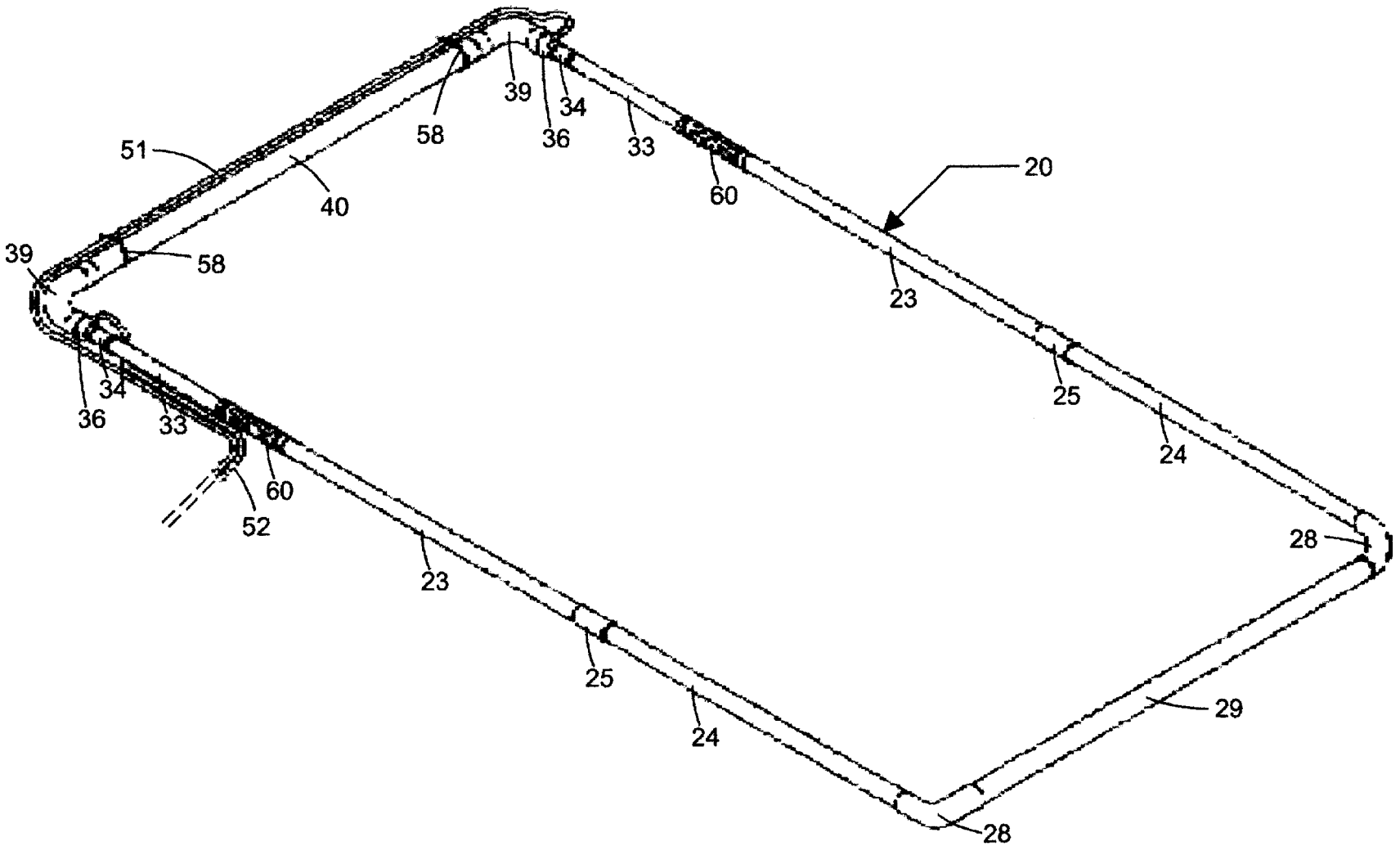
FIG. 2 is a perspective view of the apparatus shown in FIG. 1, its shroud having been removed to show air lines and the collar portion of the enclosure.

The apparatus generally designated 10 in the drawings comprises a collar generally designated 20 (best seen in FIGS. 2–13) and a waterproof shroud of flexible sheet material generally designated 80 (best seen in FIGS. 1 and 14–16).

Collar 20 includes a buoyant forward section generally designated 22 and a rearward section generally designated 32. As described below in more detail, rearward section 32 is pivotally connected to forward section 22 by means of a pair of flexible bellows joints 60.

Figure 11:
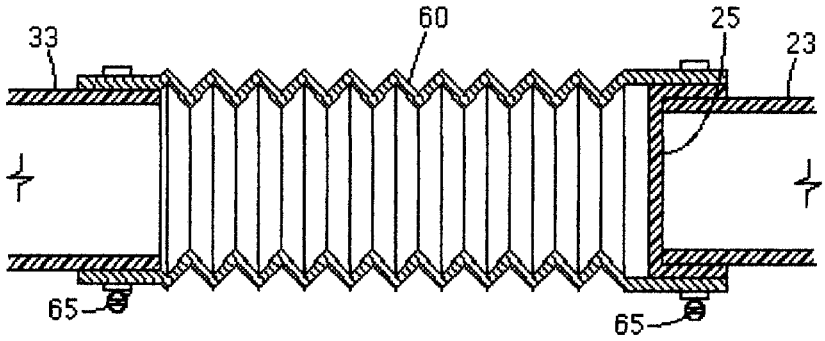
FIG. 11 is a cross-sectional view taken along section line 11—11 in FIG. 6.
Figure 12:
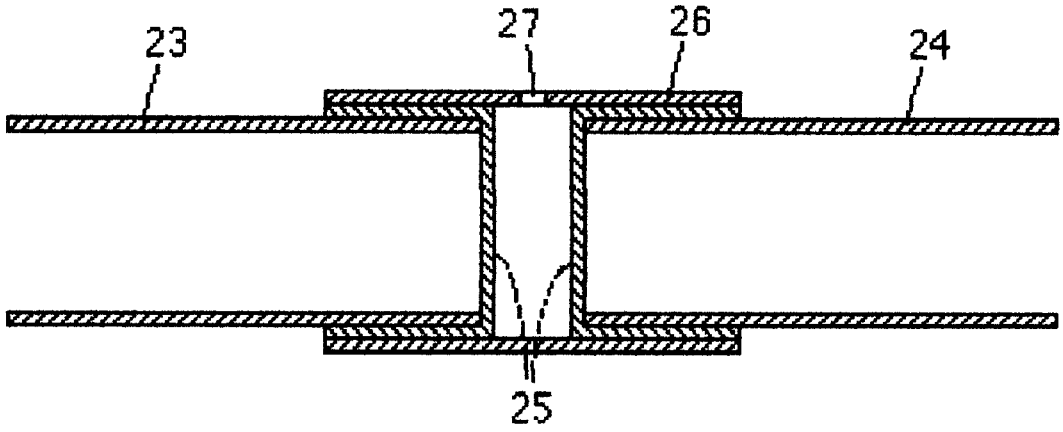
FIG. 12 is a cross-sectional view of one of the sleeve pipe joints in the forward section of the collar.
Figure 13:
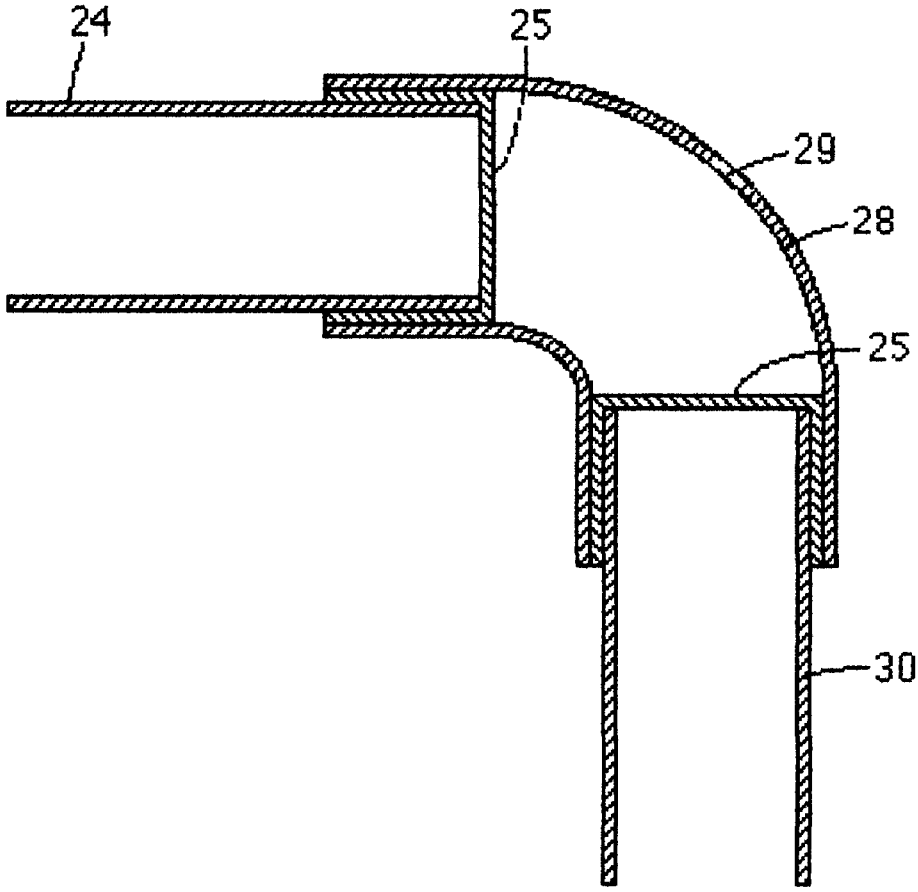
FIG. 13 is a cross-sectional view of one of the corner pipe joints in the forward section of the collar.

Each side of forward section 22 includes longitudinally extending cylindrical pipes 23, 24 adjoined by a sleeve coupling 26, the latter which includes a centrally positioned drill hole 27 extending through its wall. As best seen in FIGS. 11–13, the ends of pipes 23, 24 are closed by caps 25 which are fitted and glued over the ends to provide watertight seals which facilitate the buoyant characteristic of the forward section. The fits between sleeve coupling 26 and caps 25 at the ends of pipes 23, 24 served by the coupling are press fits. Additionally, one of the fits may be glued so that the coupling is permanently attached to either pipe 23 or pipe 24. But, to allow pipes 23, 24 to be easily separated if disassembly is desired at some future time, the other fit should remain as a press fit without glue. The purpose of drill hole 27 in sleeve coupling 26 is to allow air or water to be displaced from the coupling when the second of pipes 23, 24 is pushed into the coupling.

At its forward end, forward section 22 includes a pair of ninety degree elbow couplings 28, each of which includes a centrally positioned drill hole 29 extending through its wall. Each coupling 28 is adjoined to one of pipes 24 and to a cylindrical pipe 30, the latter of which extends between the elbow couplings transversely in relation to the sides of forward section 22. As in the case of pipes 23, 24, the ends of pipe 30 are also closed by caps 25 fitted and glued over the ends to provide a watertight seal. As well, the fits between elbow couplings 28 and caps 25 at the ends of pipes 24, 30 served by the elbow couplings are press fits. The purpose of drill hole 29 in each elbow coupling is to allow air or water to be displaced from the coupling when the second of pipes 24, 30 is pushed into the coupling.

Figure 9:
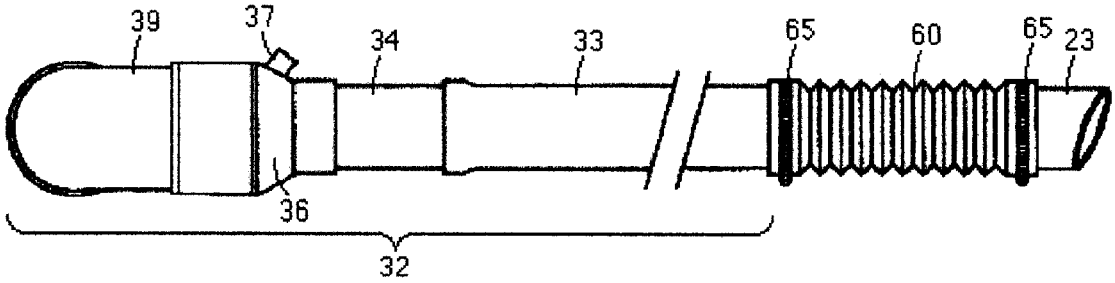
FIG. 9 is a side elevation view taken along line 9—9 in FIG. 6.
Figure 10:
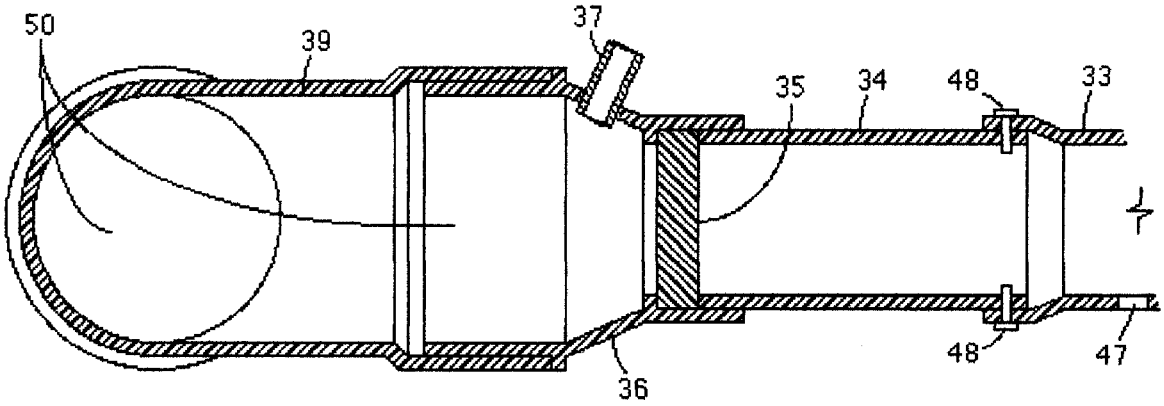
FIG. 10 is a cross-sectional view taken along section line 10—10 in FIG. 6.

Each side of rearward section 32 includes longitudinally adjoined cylindrical pipes 33, 34 and an adapter 36. An interior plug 35 is fitted within adapter 36 to close the otherwise open end of adapter 36. To allow water to flow in and drain out, pipes 33 each include a series of bottom openings 47. The connection between pipes 33 and 34 is a press fit secured by plastic screws 48 (best seen in FIG. 10). Alternately, the connection may be secured by a zip tie or the like (not shown) which is fed through holes in the top and bottom of the connection, then cinched tight. As well, and as best seen in FIGS. 9–10, a hollow stem or port fixture 37 is installed through the wall of each adapter 36.

Figure 8:
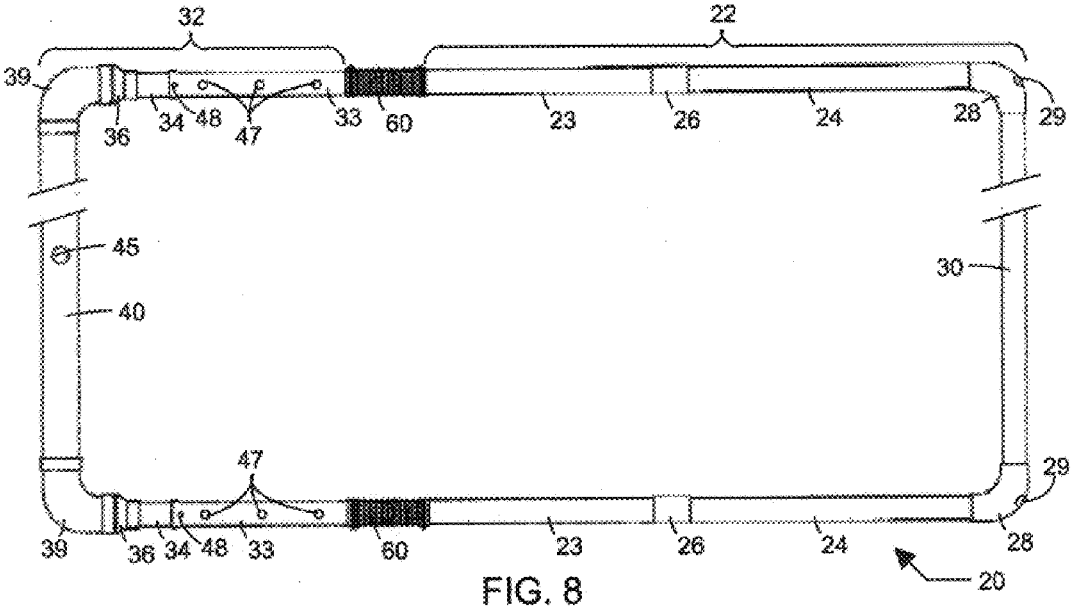
FIG. 8 is a bottom view of the collar shown in FIG. 6.

At its rearward end, rearward section 32 includes a pair of ninety degree elbow couplings 39, each adjoined to one of adapters 36 and to a cylindrical pipe 40, the latter of which extends between the elbow couplings transversely in relation to the opposed sides of rearward section 32. An interior chamber 50 in rearward section 32 is defined by the combined interior regions of pipe 40, elbow couplings 39 and adapters 36. Port fixture 37 in each adapter 36 communicates with the chamber to provide a path for air flow into or out from the chamber. As well, and as best seen in FIGS. 3 and 8, an opening or channel 45 extends from the chamber through the bottom of pipe 40 to provide a path for water flow into or out from the chamber.

All of parts 34, 35, 36, 37, 39 and 40 are glued and sealed together to form a unitary structure such that, apart from channel 45 and the opening through port fixture 37 , chamber 50 is airtight and watertight. The unitary structure cannot be disassembled except by destruction.

Figure 3:
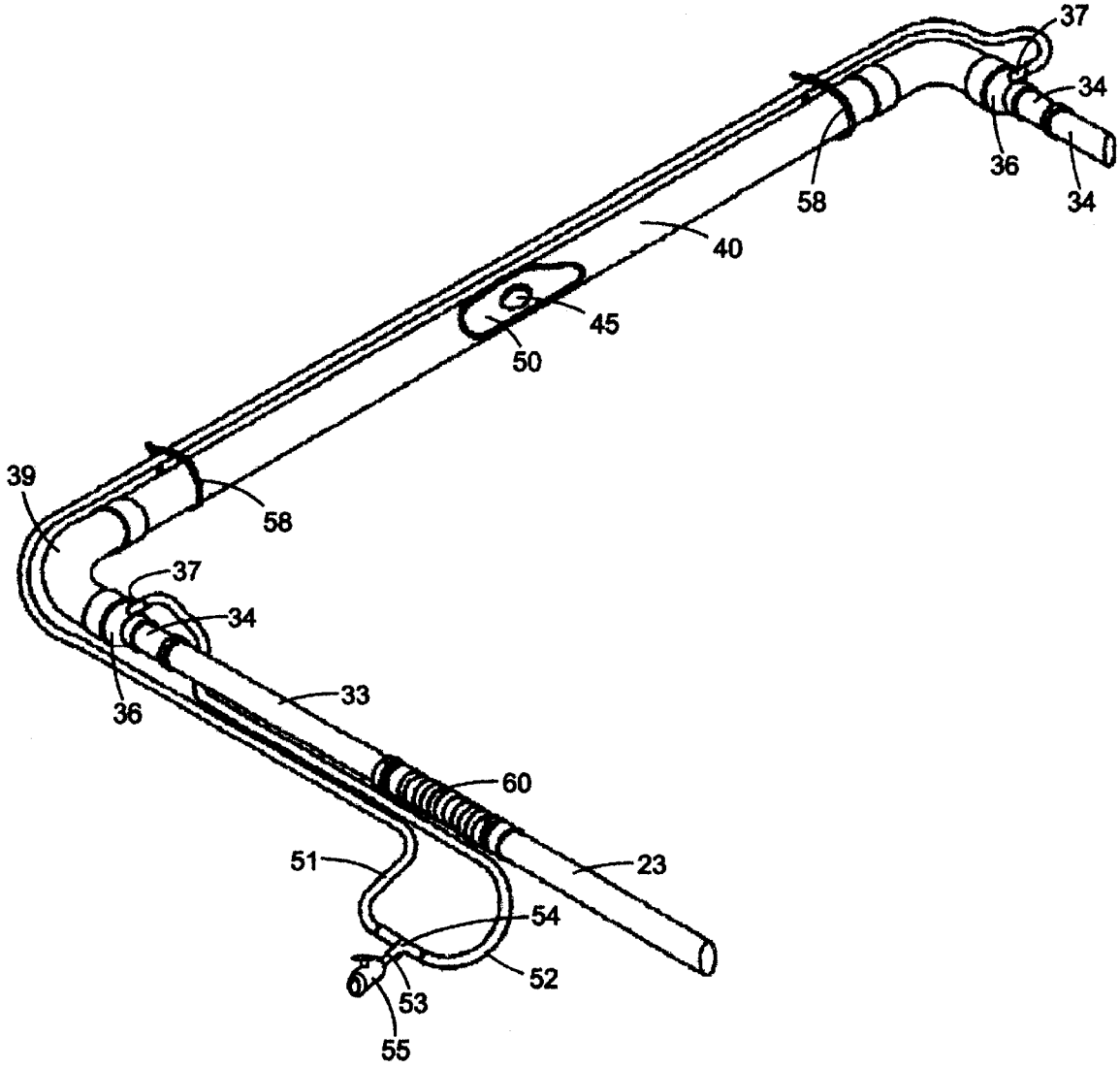
FIG. 3 is an enlarged perspective view, partially cut away, showing a portion of the collar in FIG. 2, and additionally showing a control valve and air line junction connecting with the air lines shown in FIG. 2.

Normally, and as best seen in FIG. 3, a pair of flexible, tubular air line branches 51, 52 are each connected to a respective one of port fixtures 37. Branch line 51 is loosely tied to pipe 40 by a pair of plastic straps 58. Branch lines 51, 52 are both connected to a main air flow line 53 through a tee-shaped junction 54 (the stem of the junction being coincident with the main air flow line). Main air flow line 53 is connected to a control valve 55 that, in turn, is connectable with an external source of pressurized air (not depicted in FIG. 3 but which is schematically depicted as source 150 in FIGS. 4–5). Control valve 55 is operable between a closed position blocking the flow of air through main air flow line 53 and branch lines 51, 52, and an open position permitting the flow of air through the main air flow line 53 and branch lines 51, 52.

Note that by definition the combination of valve 55 and main air flow line 53 with either one of branch lines 51, 52 can be considered as a single air flow line. Either combination may be characterized as both an air inlet line and an air outlet line.

Rearward section 32 is controllably buoyant. More particularly, if rearward section 32 is positioned in a body of water and chamber 50 is filled with air, then the section will float. Conversely, if water is permitted to flood chamber 50 through channel 45, then the section will sink.

All pipes and their couplings are preferably fabricated from strong, lightweight plastic. In a practical case of the embodiment shown, and by way of example only, collar 20 had a length of about 23 feet and a width of about 9 feet. Plastic pipe having an inside diameter of about 4 inches and an outside diameter of about 4.25 inches was found to be suitable for pipes 23, 24 and 30. In the case of pipe 40, a larger pipe, having an inside diameter of about 6.5 inches and an outside diameter of about 7 inches was used. The larger pipe (providing a larger interior space for air) was found to be necessary to provide sufficient buoyancy for rearward section 32.

Of course, in any given case, it will be understood that the inside and outside diameters of the pipes as indicated above may differ from the given dimensions. Further, the overall length and width of the collar may be readily altered to accommodate differing hull sizes by using pipes of greater or lesser length, or, in the case of length, by using a greater or fewer number of pipes and couplings between pipes. For example, pipes 23, 24 and coupling 26 could be replaced by one long pipe. But, the benefit of doing so would have to be balanced against the disadvantage of the larger longitudinal space that the pipe would occupy during storage or transportation in a disassembled condition. As well, and at least in principle, it will be recognized that forward section 22 and rearward section 32 could each be fabricated without pipe joints or couplings, but the result would be a customized construction occupying a significant amount of space both lengthwise and widthwise when disassembled.

As noted above, rearward section 32 is pivotally connected to forward section 22 by means of a pair of flexible bellows joints 60. Advantageously, it has been found that commercially available tubular U-joint bellows which are normally used on the outdrive portion of a marine engines can be used to provide suitable hinge action. Such bellows are well designed for use in marine environments. Further, during assembly of collar 20, they enable rearward section 32 to be quickly and easily connected to forward section 22 with the use of hose clamps 65.

Of course, other more conventional hinge mechanisms may be devised to pivotally connect rearward section 32 to forward section 22. For example, a variety of pivot pin mechanisms might be used in substitution for bellows joints 60. However, at least to date, no commercially available mechanism that would not require a significant amount of custom adaptation or fabrication has been found.

Figure 15:
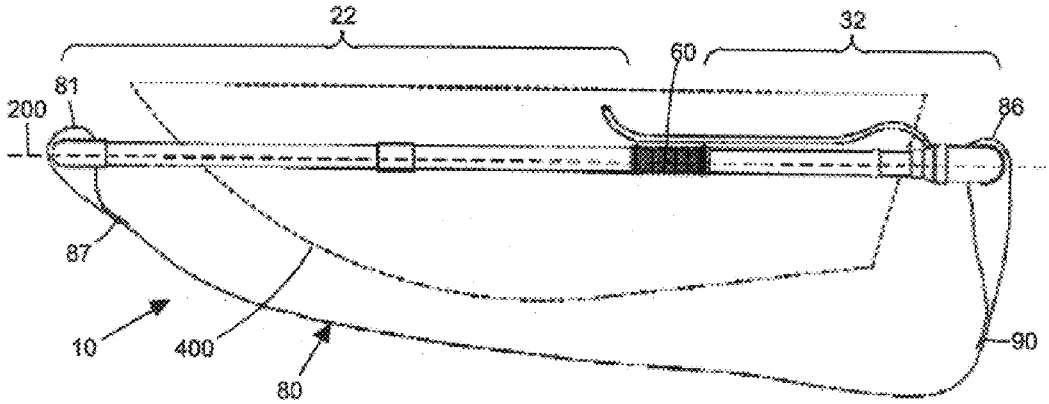
FIG. 15 is a side elevation view illustrative of a boat hull when contained by the apparatus shown in FIG. 1, the rearward section of the collar being in a floating position.
Figure 16:
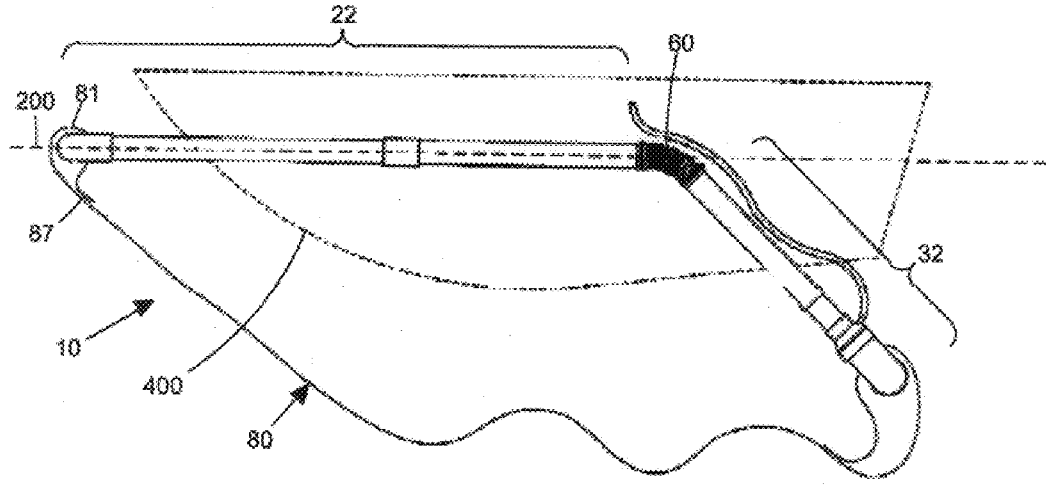
FIG. 16 is a side elevation view as in FIG. 15, but with the rearward section of the collar in a sunken position.

Shroud 80 is suspended from and extends around the periphery of collar 20. More particularly, and as best indicated in FIGS. 1, 15 and 16, shroud 80 includes upper hemmed portions 81–86 which provide hems through which the components of collar 20 are inserted during assembly of the collar. The lower edges of the hemmed portions include stitching as, for example, along stitch lines 87–90. Although stitch lines for hemmed portions 83, 85 are not shown, it will be understood that they are similar to stitch lines 88, 89 for hemmed portions 82, 84. As well, it will be understood that stitch line 87 of hemmed portion 81 (indicated only in FIGS. 15–16) extends longitudinally in a manner similar to stitch line 90 of hemmed portion 86 as shown in FIG. 1, but at a lower elevation.

All stitch lines except stitch line 90 extend horizontally at about the same distance below the top of shroud 80 (e.g. about 12 inches in the present embodiment). But, as best seen in FIG. 15, stitch line 90 is at a significantly lower position (e.g. about 28 inches in the present embodiment). The lower position of stitch line 90 provides a larger hem size that permits rearward section 32 of collar 20 with air lines attached but not including pipes 33 to be preassembled outside the shroud, then fitted through the hem. In the case of forward section 22 which has significantly longer sides than rearward section 32, assembly may conveniently take place almost entirely within the hemmed portions of the shroud. More particularly, on each side of the forward section, pipes 23 and 24 with sleeve 26 already fitted to one of the pipes can by feel be pushed together within hemmed portion 82 or 83, as the case may be. Pipe 30, with or without elbow couplings 28 already attached, is separately fitted through the hem provided by hemmed portion 81.

As illustrated by the example of opened flaps 91 in FIG. 1, the four upper corners of shroud 80 are cut to provide access to the comers of collar 20. The provision of such flaps facilitates assembly and disassembly. More particularly, in forward section 22, the comer flaps provide access which allows pipes 24 and 30 to be connected to or disconnected from elbow couplings 28. Similarly, in rearward section 32, and assuming that the rearward section has been partly preassembled as discussed above, the corner flaps provide access which allows pipes 33 to be connected to or disconnected from pipes 34 of the preassembled part.

Shroud 80 is also cut to provide flaps 92, 93 that normally cover bellows joints 60 on each side of collar 20. This permits the forward and rearward sections 22, 23 of the collar to be connected by the bellows joints after they have been installed in the shroud. As well, this permits the bellows when installed to be easily serviced or replaced if necessary.

Shroud 80 also includes an arm sized opening or hole 94 cut in the center part of hemmed portion 86. Hole 94 is positioned to allow a user to reach through the shroud to channel 45 in pipe 40 and, if necessary, to plug channel 45 with a cork or similar device (not shown). Normally, no such action should be necessary. However, in the event that chamber 50 develops an air leak allowing the chamber to flood through channel 45, then a cork can be used to maintain rearward section 32 in a floating position until the source of the leak is found and repaired. As well, a cork can serve as a fail safe device even if there is no immediate leak. In the case of long term storage, the use of cork as a fail safe device is recommended.

Hemmed portions 81, 82, 83 of shroud 80 each include a strip which is pinched in the shroud material to form a double layer seam 95, 96, 97, as the case may be. A number of grommets 98 are placed at intervals along the length of each seam. As discussed below in relation to FIG. 14, the purpose of the grommeted seams is to facilitate mooring of apparatus 10 to a dock.

Shroud 80 may be fabricated from various suitable materials. The material should be waterproof, lightweight, and have a high tensile and tear strength in relation to its lightweight. It should be easy to handle, cut and sew. As well, it should be resistant to climate extremes including ultraviolet exposure, and to rot, mildew and to chemicals that may be used to treat water within the shroud. A preferred material is a woven polyethylene fabric.

In some cases, it may be found that part of a shroud such as shroud 80 may tend to float or drift upwardly against a hull contained within the shroud. If unwanted, then such drifting normally can be avoided by placing small weight bags (not shown) on the bottom of the shroud. To prevent excessive movement of the bags themselves, they can be tethered to collar 20. Of course, the added weight should not defeat the buoyancy of the collar.

Figure 14:
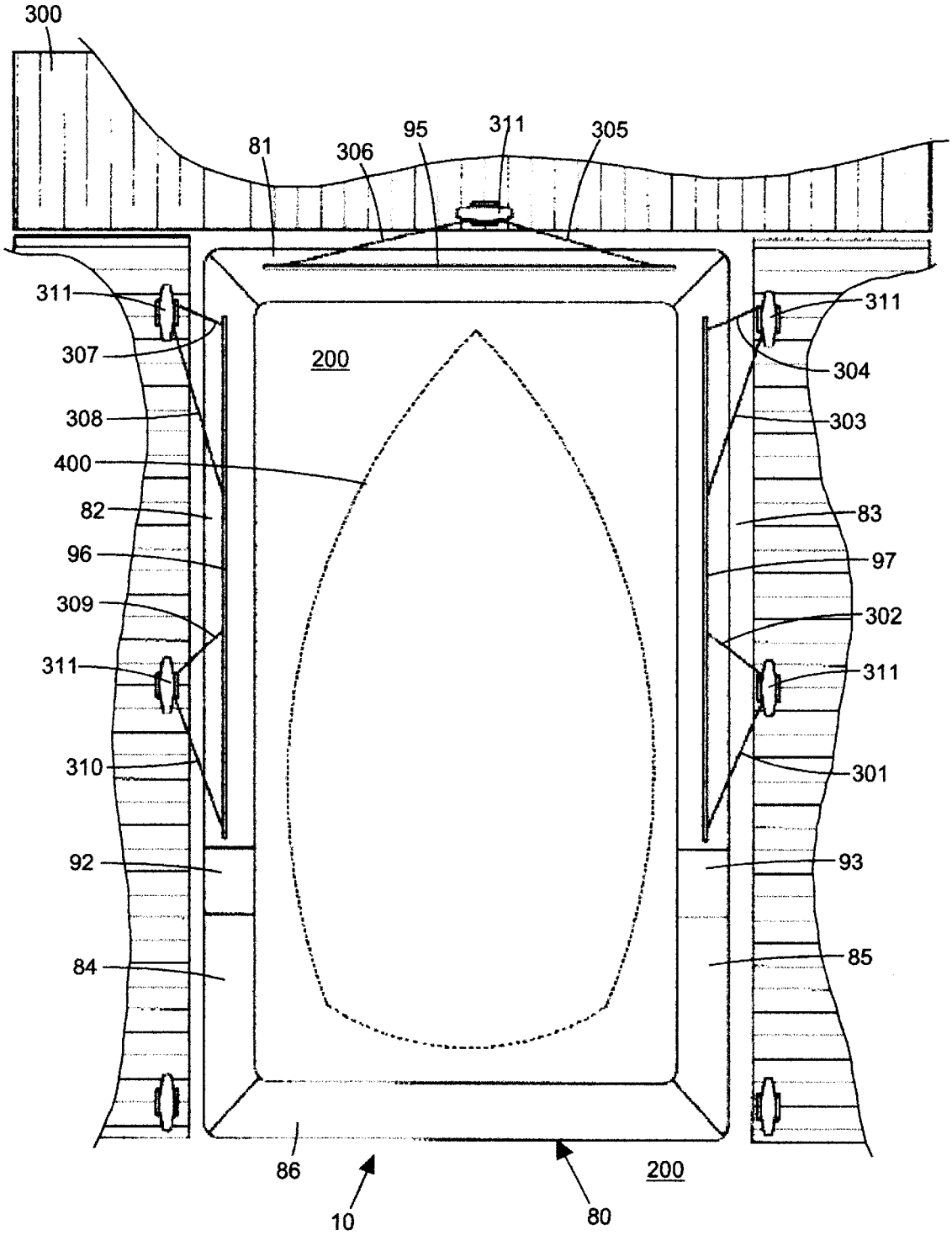
FIG. 14 is a top view of the protective enclosure of FIG. 1 when the apparatus is moored to a dock and in use.

In use, and as illustrated in FIGS. 14–16, collar 20 with shroud 80 suspended therefrom floats in a body of water 200. The periphery of the collar 20 is sized to extend around hull 400 of a boat or other watercraft at a distance from the hull. As discussed above, shroud 80 is sized to extend around the periphery of the collar. As well, and as best seen in FIGS. 15–16, shroud 80 is sized to extend below hull 400 while suspended from the collar.

In FIG. 14, apparatus 10 is moored to a dock 300 by means of mooring lines 301–310 and cleats 311. Each mooring line extends from one of cleats 311 and is clipped to one of grommets 98 (see FIG. 1) in seams 95–97. While mooring is not considered to be essential, it normally will be considered desirable.

Figure 4:
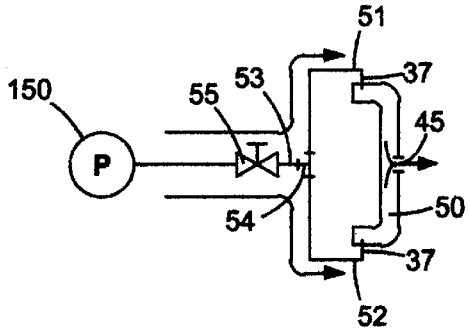
FIG. 4 is a schematic diagram illustrating air flow paths from an external source of pressurized air.

Assuming that rearward section 32 of collar 20 is in a sunken position as shown in FIG. 16, and a user desires to raise the section to a floating position, then, as depicted in FIG. 4, an external source of pressurized air 150 is connected to valve 55. Source 150 may be a simple mechanical device such as manual pump, or it may be a more sophisticated device that does not require manual labor. For example, there are a variety of air compressors designed to operate on conventional AC power and, likewise, there are a variety of air compressors designed to operate on DC power such as battery power. In any case, when source 150 is connected and valve 55 is opened, air may be forced along the paths indicated in FIG. 4 into chamber 50 through main line 53, branch lines 51, 52 and port fixtures 37. As air enters chamber 50, water is expelled through channel 45: When sufficient air has entered the chamber, rearward section 32 becomes buoyant and pivots to the floating position shown in FIGS. 14 and 15. In this position, water within pipes 33 drains through openings 47.

Figure 5:
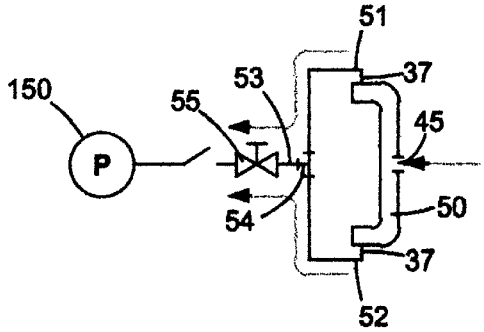
FIG. 5 is a schematic diagram as in FIG. 4, but when the external source of pressurized air is disconnected.
Figure 6:
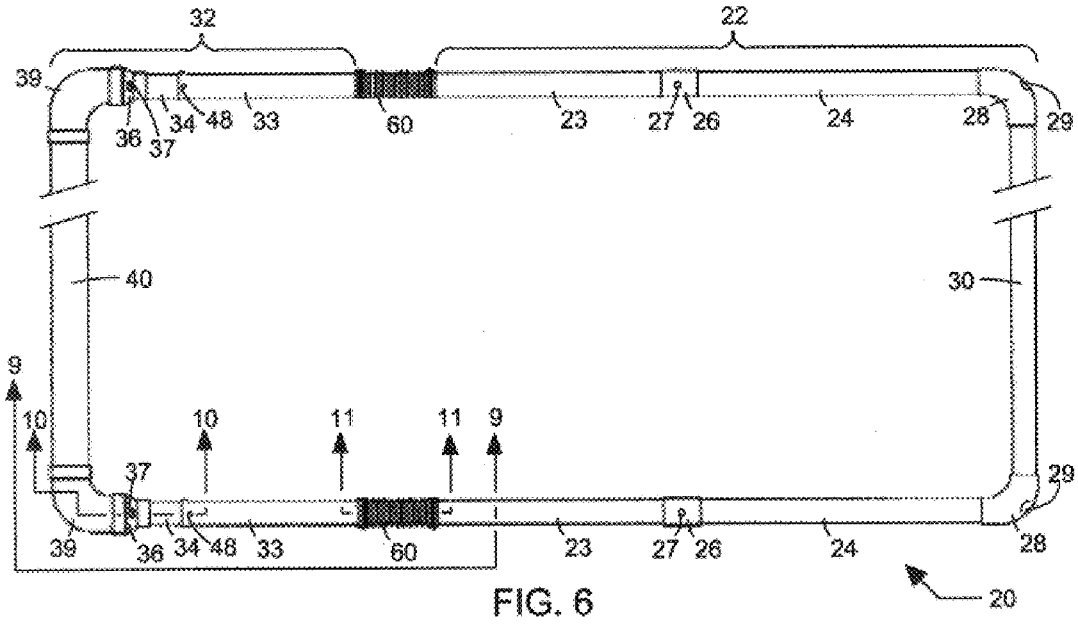
FIG. 6 is a top view of the collar shown in FIG. 2, but without the air lines as shown in FIG. 2.
Figure 7:
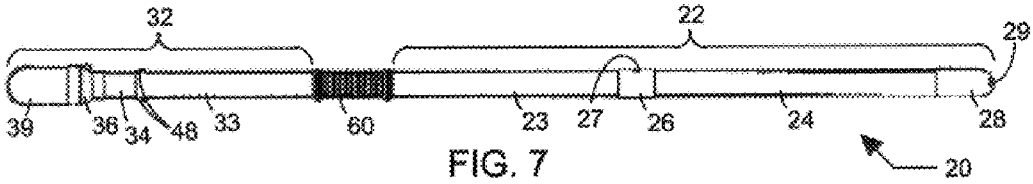
FIG. 7 is a side elevation view of the collar shown in FIG. 6.

When rearward section 32 is in its floating position, valve 55 can be closed and source 150 can be disconnected as schematically indicated in FIG. 5. Absent any air leaks, rearward section 32 will remain in its floating position. If valve 55 is subsequently opened, then, as indicated by the broken lines in FIG. 5, main line 53, branch lines 51, 52 and port fixtures 37 together provide paths for the egress of air from chamber 50 under the pressure of water flooding the chamber through channel 45. When sufficient water has flooded chamber 50, rearward section 32 loses its buoyancy and pivots to the sunken position shown in FIG. 16. As it pivots, water floods pipes 33 through bottom openings 47. With rearward section 32 in its sunken position, hull 400 is free to be moved into or out from the confines of apparatus 10.

A variety of modifications, changes and variations to the invention are possible within the spirit and scope of the following claims, and will undoubtedly occur to those skilled in the art. The invention should not be considered as restricted to the specific embodiment that has been described and illustrated with reference to the drawings.

We claim:

1. Apparatus for protecting a hull of a watercraft floating in a body of water, said apparatus comprising a waterproof shroud of flexible sheet material and a collar which is floatable in said body of water while carrying the weight of said shroud, said collar having a periphery sized to extend around said hull at a distance from said hull, said shroud being sized to extend around the periphery of said collar and below said hull while suspended from said collar, said collar comprising:

(a) a buoyant forward section having opposed sides and a forward end extending therebetween; and, (b) a controllably buoyant rearward section having opposed sides and a rearward end extending therebetween, the opposed sides of said rearward section being pivotally connected to the opposed sides of said forward section for pivotal movement of said rearward section between a horizontal floating position and a sunken position, said rearward section extending downwardly and rearwardly from said forward section when in said sunken position, said rearward section including:

(i) an interior chamber for containing sufficient air to provide buoyancy for said rearward section, said rearward section being non-buoyant when said chamber is filled with water; and, (ii) a non-sinuous channel extending between a first end in communication with said chamber and a second end for communicating with said body of water to thereby provide a non-sinuous bi-directional water flow path between said chamber and said body of water;

said apparatus further comprising:

(c) means for controllably directing air from an external source of pressurized air into said chamber to expel water from said chamber through said channel; and, (d) means for controllably allowing said chamber to flood through said channel with water from said body of water.

2. Apparatus for protecting a hull of a watercraft floating in a body of water, said apparatus comprising a waterproof shroud of flexible sheet material and a collar which is floatable in said body of water while carrying the weight of said shroud, said collar having a periphery sized to extend around said hull at a distance from said hull, said shroud being sized to extend around the periphery of said collar and below said hull while suspended from said collar, said collar comprising:

(a) a buoyant forward section having opposed sides and a forward end extending therebetween; and, (b) a controllably buoyant rearward section having opposed sides and a rearward end extending therebetween, the opposed sides of said rearward section being pivotally connected to the opposed sides of said forward section for pivotal movement of said rearward section between a horizontal floating position and a sunken position, said rearward section extending downwardly and rearwardly from said forward section when in said sunken position, said rearward section including:

(i) an interior chamber for containing sufficient air to provide buoyancy for said rearward section, said rearward section being non-buoyant when said chamber is filled with water; and, (ii) a non-sinuous channel extending between a first end in communication with said chamber and a second end for communicating with said body of water to thereby provide a non-sinuous bi-directional water flow path between said chamber and said body of water;

said apparatus further comprising:

(c) an air inlet line for directing a controlled flow of air from an external source of pressurized air into said chamber to expel water from said chamber through said channel; and, (d) an air outlet line for permitting a controlled escape of air from said chamber thereby allowing said chamber to flood through said channel with water from said body of water.

3. Apparatus for protecting a hull of a watercraft floating in a body of water, said apparatus comprising a waterproof shroud of flexible sheet material and a collar which is floatable in said body of water while carrying the weight of said shroud, said collar having a periphery sized to extend around said hull at a distance from said hull, said shroud being sized to extend around the periphery of said collar and below said hull while suspended from said collar, said collar comprising:

(a) a buoyant forward section having opposed sides and a forward end extending therebetween; and, (b) a controllably buoyant rearward section having opposed sides and a rearward end extending therebetween, the opposed sides of said rearward section being pivotally connected to the opposed sides of said forward section for pivotal movement of said rearward section between a horizontal floating position and a sunken position, said rearward section extending downwardly and rearwardly from said forward section when in said sunken position, said rearward section including:

(i) an interior chamber for containing sufficient air to provide buoyancy for said rearward section, said rearward section being non-buoyant when said chamber is filled with water; and, (ii) a non-sinuous channel extending between a first end in communication with said chamber and a second end for communicating with said body of water to thereby provide a non-sinuous bi-directional water flow path between said chamber and said body of water;

said apparatus further comprising a valve controlled air flow line for controllably directing a flow of air from an external source of pressurized air into said chamber to expel water from said chamber through said channel, and for controllably permitting the escape of air from said chamber thereby allowing said chamber to flood through said channel with water from said body of water.

4. Apparatus as defined in claim 3, wherein said interior chamber extends within said rearward end between said sides of said rearward section.

5. Apparatus as defined in claim 4, wherein said channel is positioned in said rearward end centrally between said sides of said rearward section.

6. Apparatus as defined in claim 4, wherein said air flow line comprises:

(a) a main line extending from said control valve to a junction;

(b) a first branch line extending from said junction to said chamber through a first one of said sides of said rearward section; and, (c) a second branch line extending from said junction to said chamber through the opposed one of said sides of said rearward section.

7. Apparatus as defined in claim 6 wherein said channel is positioned in said rearward end centrally between said sides of said rearward section.

8. Apparatus as defined in claim 3, wherein said forward section comprises a first plurality of adjoined pipes, and wherein said rearward section comprises a second plurality of adjoined pipes.

9. Apparatus as defined in claim 3, wherein:

(a) said forward section comprises a first plurality of adjoined pipes;

(b) said rearward section comprises a second plurality of adjoined pipes; and, (b) said opposed sides of said rearward section are pivotally connected to the opposed sides of said forward section, each by a flexible bellows joint.

* * * * *